US006634497B1

(12) United States Patent
Chang

(10) Patent No.: US 6,634,497 B1
(45) Date of Patent: Oct. 21, 2003

(54) GOLF BAG SUPPORT MECHANISM

(76) Inventor: Shu-Chin Chang, 36, Lane 64, Tzu Chih Road, Ta Tu Village, Ta Tu Hsiang, Taichung-Hsien (TW)

( * ) Notice: Subject to any disclaimer, the term of this patent is extended or adjusted under 35 U.S.C. 154(b) by 0 days.

(21) Appl. No.: 09/644,208

(22) Filed: Aug. 23, 2000

(51) Int. Cl.[7] ..... A61B 55/00
(52) U.S. Cl. ..... 206/315.7; 248/96
(58) Field of Search ..... 206/315.7, 315.2, 206/315.3, 315.8; D3/31, 255; 248/96

(56) References Cited

U.S. PATENT DOCUMENTS 5,857,567 A * 1/1999 Cheng ..... 206/315.7
6,010,101 A * 1/2000 Stein et al. ..... 248/96
6,098,797 A * 8/2000 Han ..... 206/315.7
6,220,433 B1 * 4/2001 Kang ..... 206/315.7
6,241,201 B1 * 6/2001 Wang ..... 248/96
6,264,028 B1 * 7/2001 Wu ..... 206/315.7
6,315,117 B1 * 11/2001 Han ..... 206/315.7

* cited by examiner

*Primary Examiner*—Lee Young
*Assistant Examiner*—Lien Ngo
(74) *Attorney, Agent, or Firm*—Bacon & Thomas, PLLC

(57) ABSTRACT

A support mechanism mounted on golf bag. The support mechanism includes a bottom member including a space and an arcuate flange projected on the edge of the space, a base including an extension and a perforation between the extension and the body of the base, a fabric coupled between the bottom member and the base for enclosing the space, supports having bottom ends pivotably coupled to the base and legs having top ends pivotably coupled to the supports. Inclined legs can stably support the bag on the ground. This also facilitates the access of golf clubs contained in the bag.

2 Claims, 8 Drawing Sheets

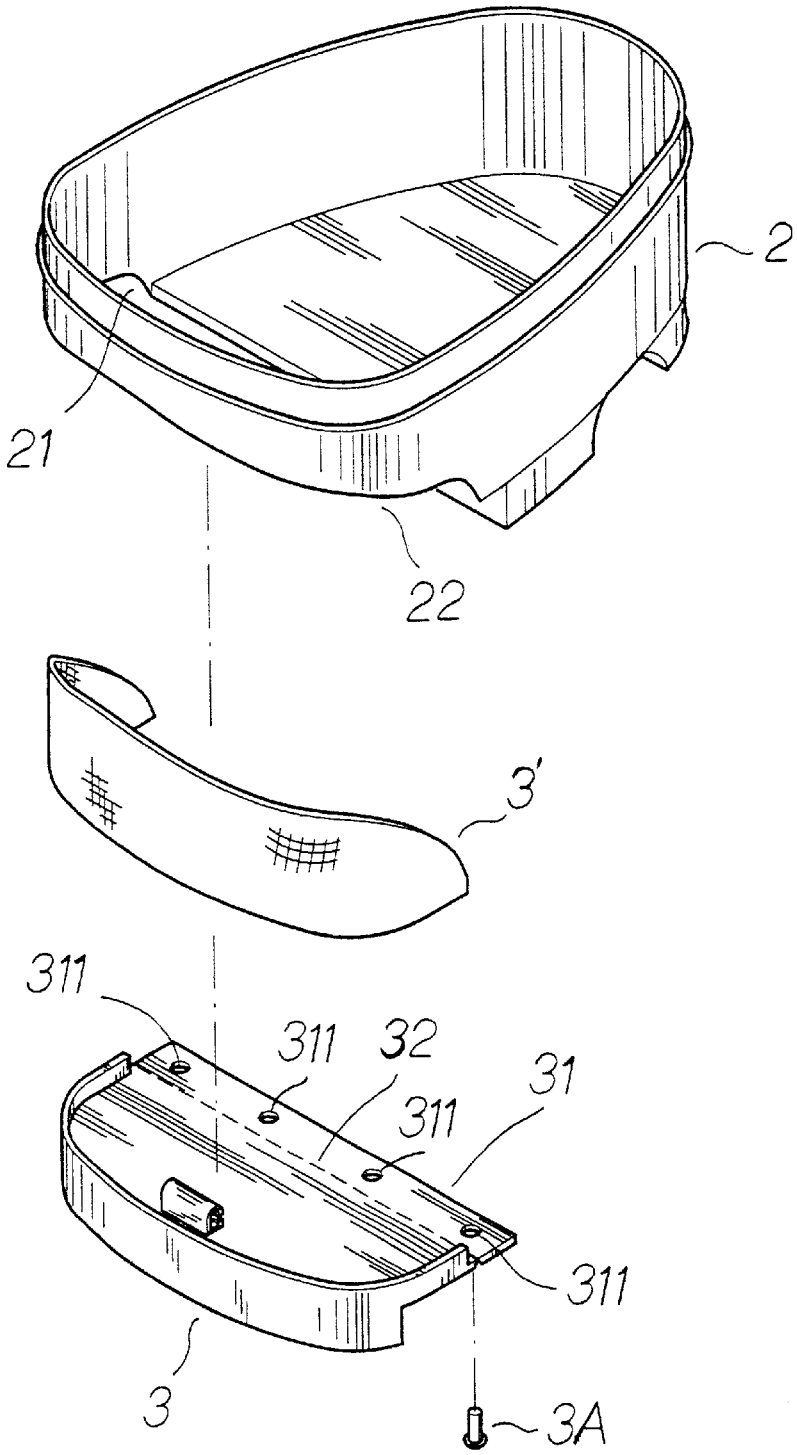
FIG.3-A

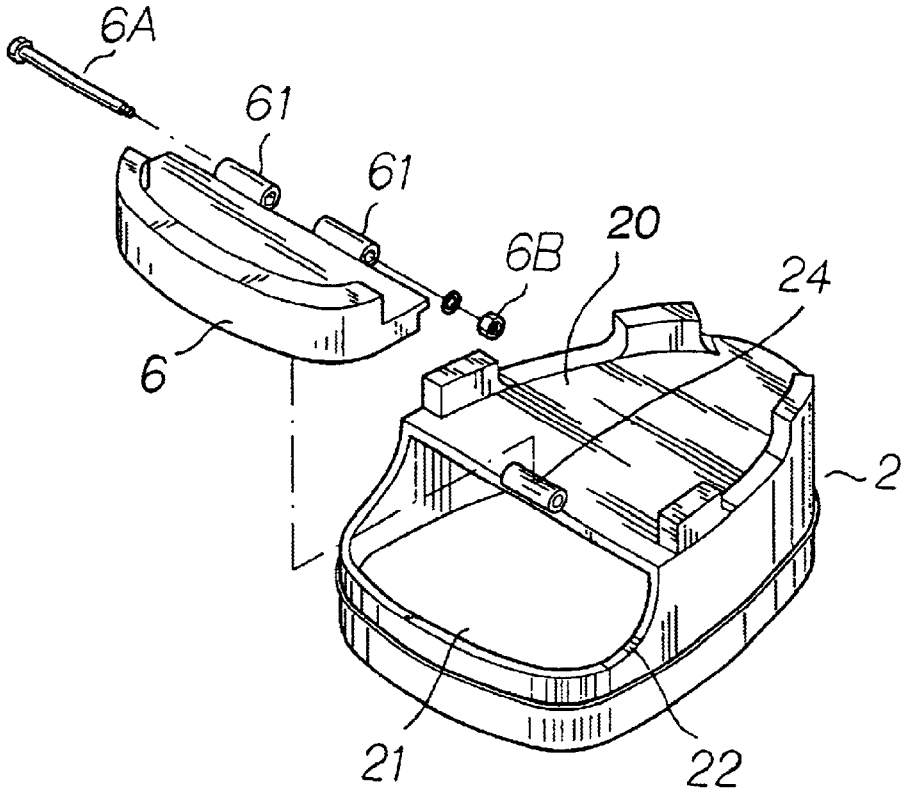
FIG. 4-A
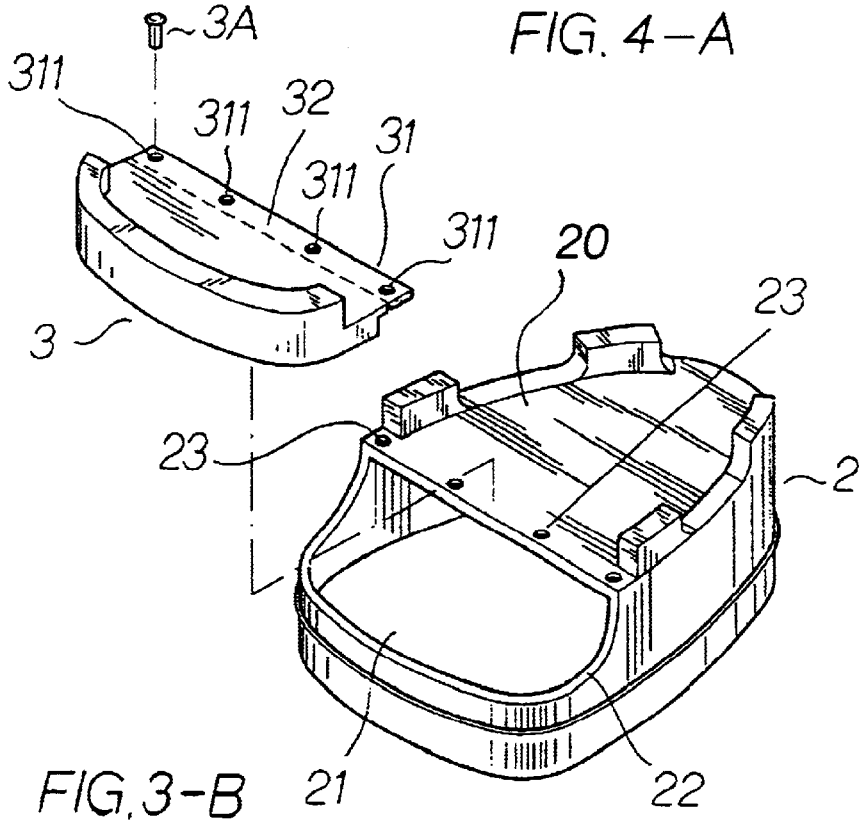
FIG. 3-B

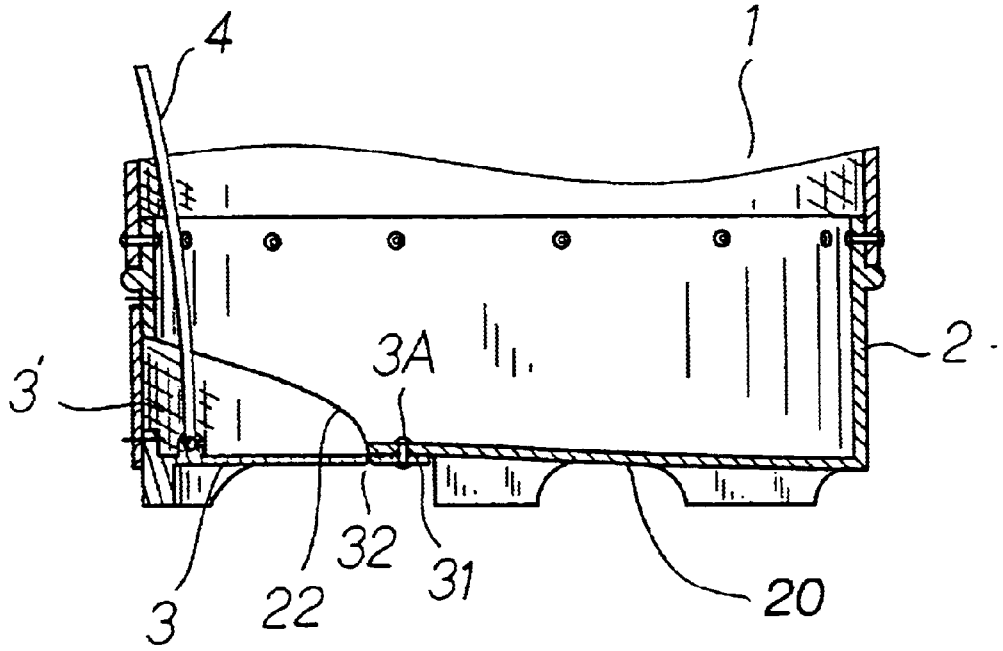
FIG. 3—C
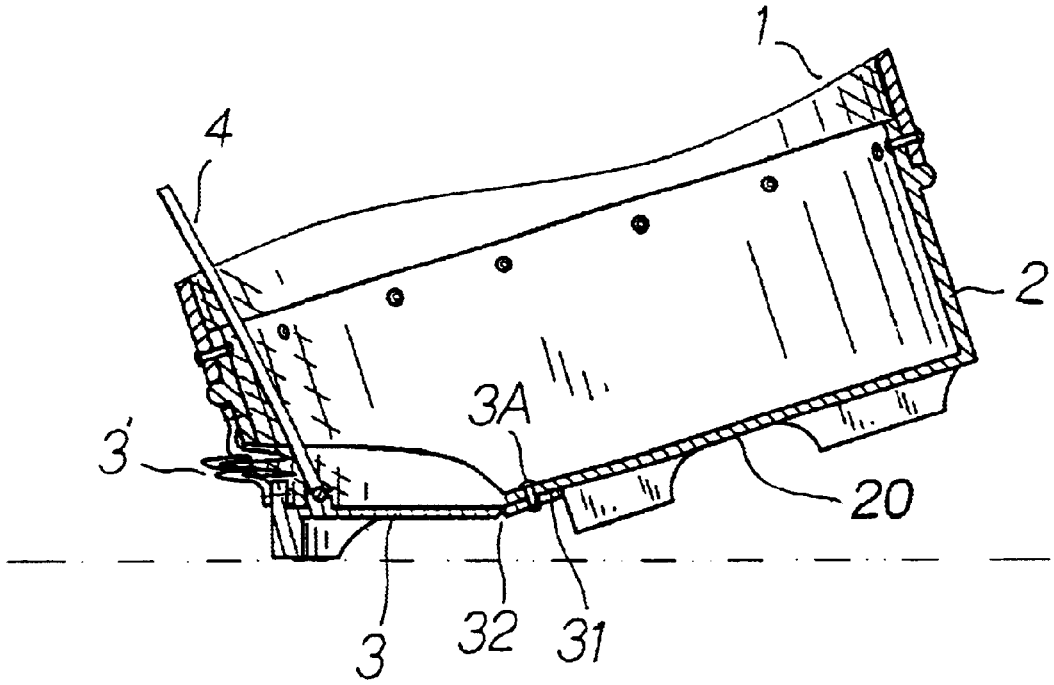
FIG. 3—D

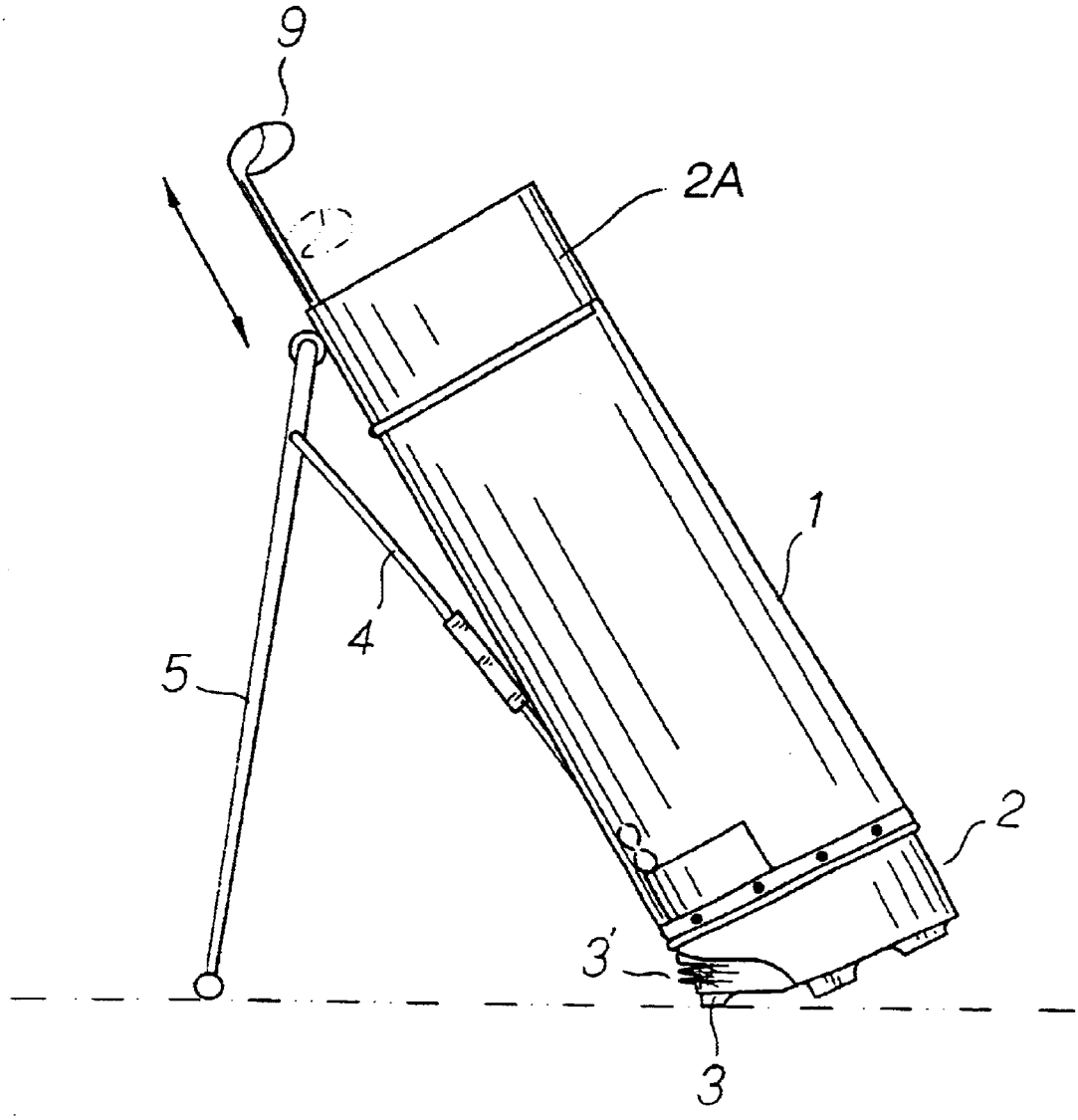
FIG. 3-E

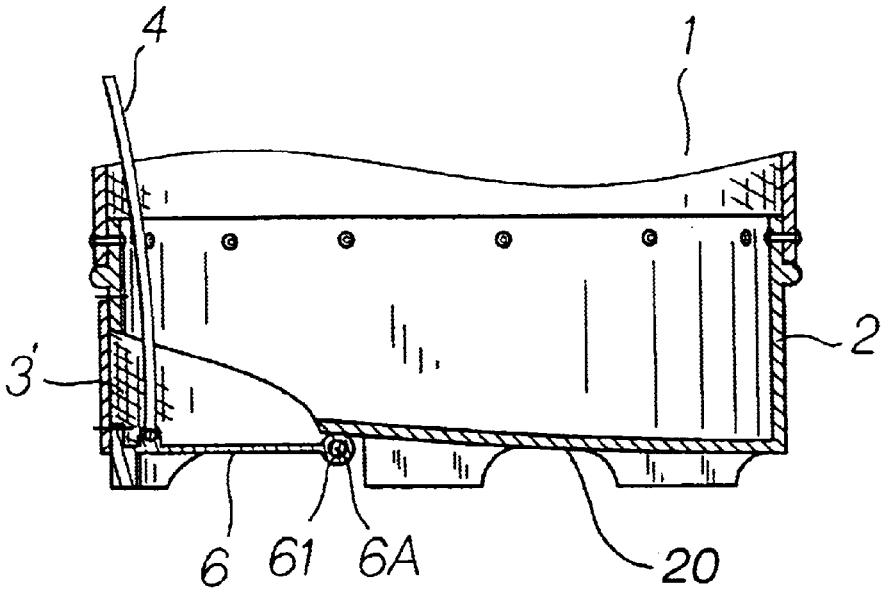
FIG. 4-B
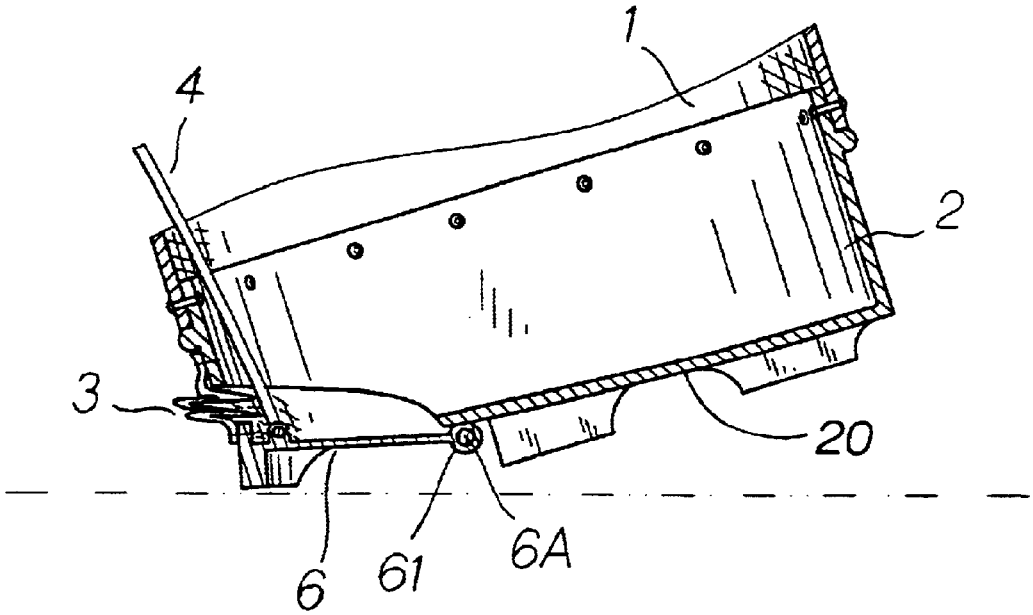
FIG. 4-C

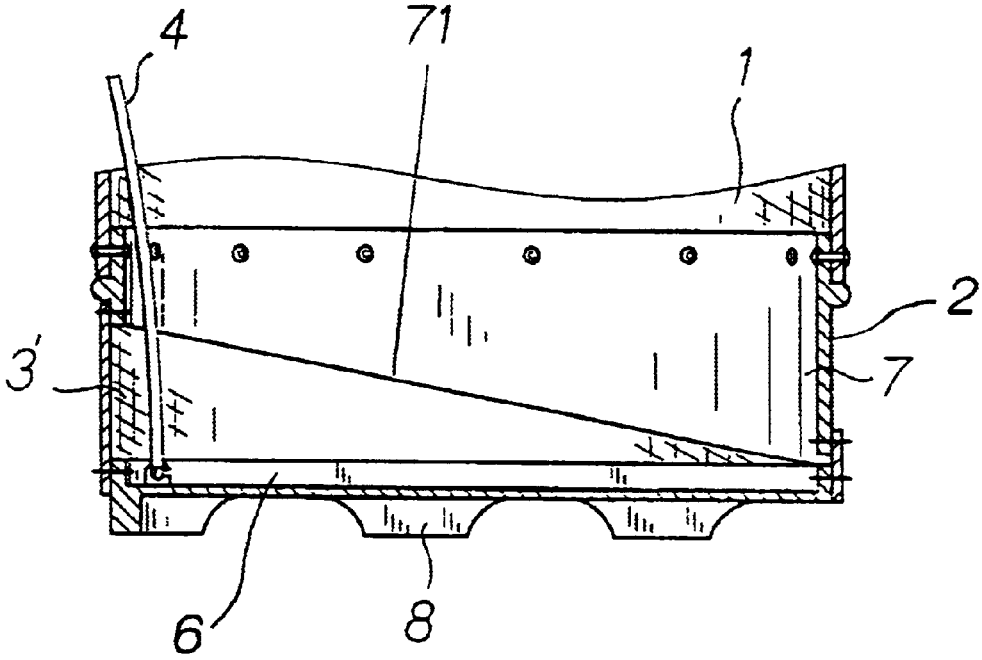
FIG. 5-A
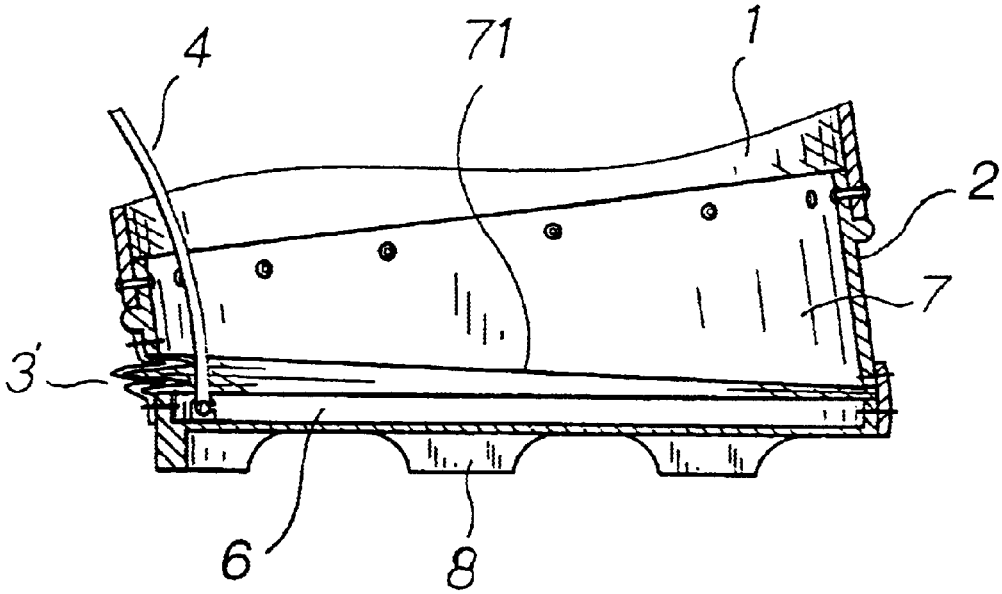
FIG. 5-B

GOLF BAG SUPPORT MECHANISM

FIELD OF THE INVENTION

The present invention relates to a support device and more particularly to a golf bag support mechanism.

BACKGROUND OF THE INVENTION

A conventional golf bag with support mechanism is shown in FIG. 1 comprising a bag A, two legs B pivotably attached to bag A, and a support C having a base C1 pivotably attached to bag A. In use, user may pull bag A outward to form an angle with respect to legs B (i.e., inclined) for stably placing bag A on the ground. However, the previous design suffered from two disadvantages:

1. It is unsightly because there is a gap between base C1 and bottom slope A1 of bag A.
2. It is not stable due to the flat surface contact between base C1 and ground. In use, golf bag is susceptible to fall when a foreign object slightly collides with it.

SUMMARY OF THE INVENTION

It is thus an object of the present invention to provide a support mechanism mounted on golf bag comprising a bottom member including a space and an arcuate flange projected on the edge of the space; a base including an extension and a perforation between the extension and the body of the base; a fabric coupled between the bottom member and the base for enclosing the space; a plurality of supports having bottom ends pivotably coupled to the base and a plurality of legs having top ends pivotably coupled to the supports. Inclined legs can stably support bag on the ground. This also facilitates the access of golf clubs contained in the bag. Moreover, this golf bag is aesthetic.

It is another object of the present invention to provide a support mechanism for golf bag wherein the base and the bottom member are hinged together.

The above and other objects, features and advantages of the present invention will become apparent from the following detailed description taken with the accompanying drawings.

BRIEF DESCRIPTION OF THE DRAWINGS

FIG. 3A is an exploded view of bottom member of bag, fabric and base shown in FIG. 2;

FIG. 3B is an inverted view of FIG. 3A wherein fabric is removed;

FIG. 3C is a cross-sectional view of the FIG. 2 support mechanism;

FIG. 3D is similar to FIG. 3C for illustrating the operation of the FIG. 2 support mechanism;

FIG. 3E is a perspective view of the FIG. 2 support mechanism where golf bag inclined by the support of support mechanism;

FIG. 4A is an inverted exploded view of a second preferred embodiment of support mechanism according to the invention;

FIG. 4B is a cross-sectional view of of the FIG. 4A support mechanism;

FIG. 4C is similar to FIG. 4B for illustrating the operation of the FIG. 4A support mechanism;

FIG. 5A is a cross-sectional view of a third preferred embodiment of support mechanism according to the invention; and FIG. 5B is similar to FIG. 5A for illustrating the operation of the FIG. 5A support mechanism.

DETAILED DESCRIPTION OF THE PREFERRED EMBODIMENTS

Figure 1:
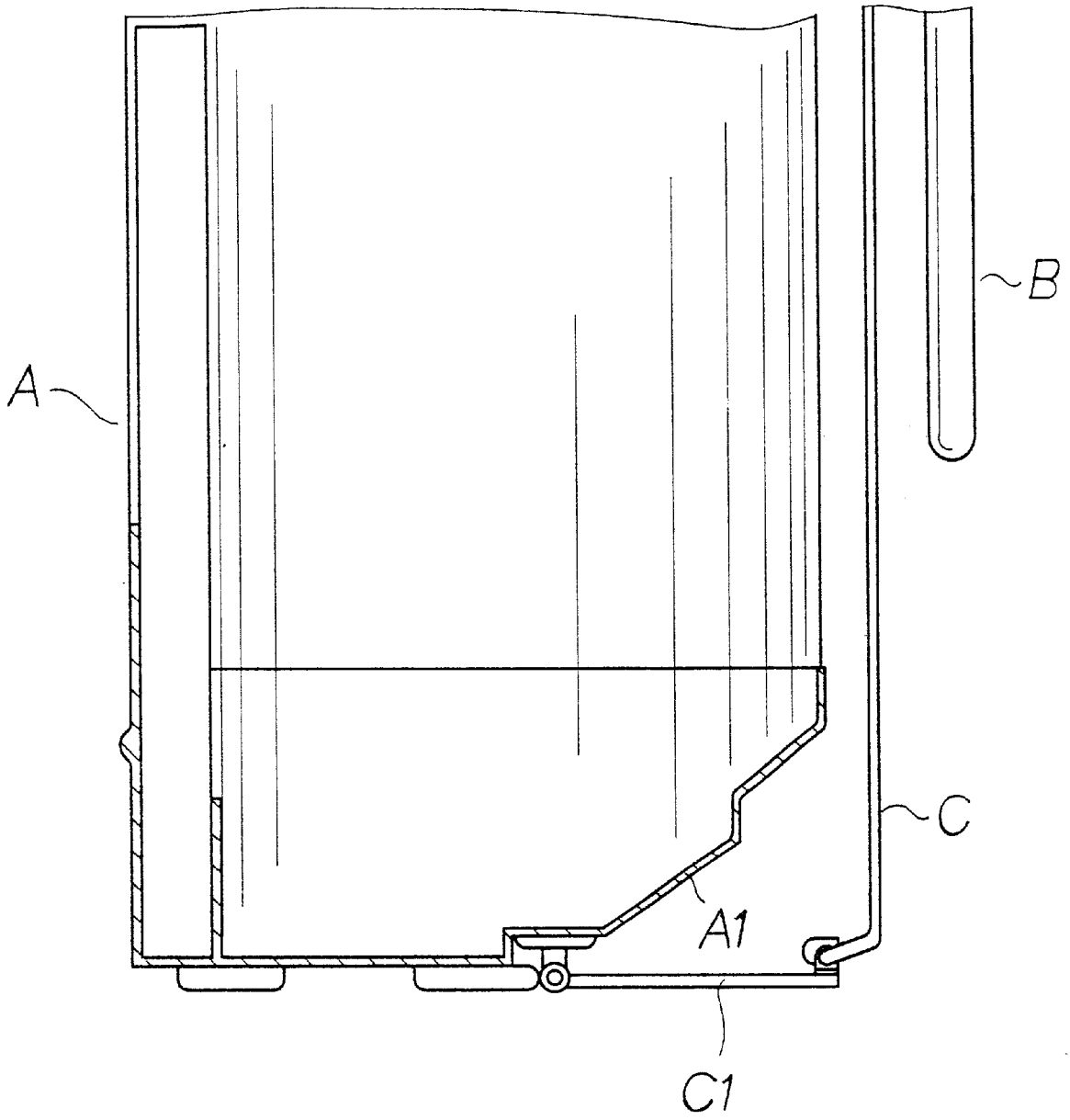
FIG. 1 PRIOR ART
FIG. 1 is a side view in part section of the lower part of a conventional golf bag support mechanism.
Figure 2:
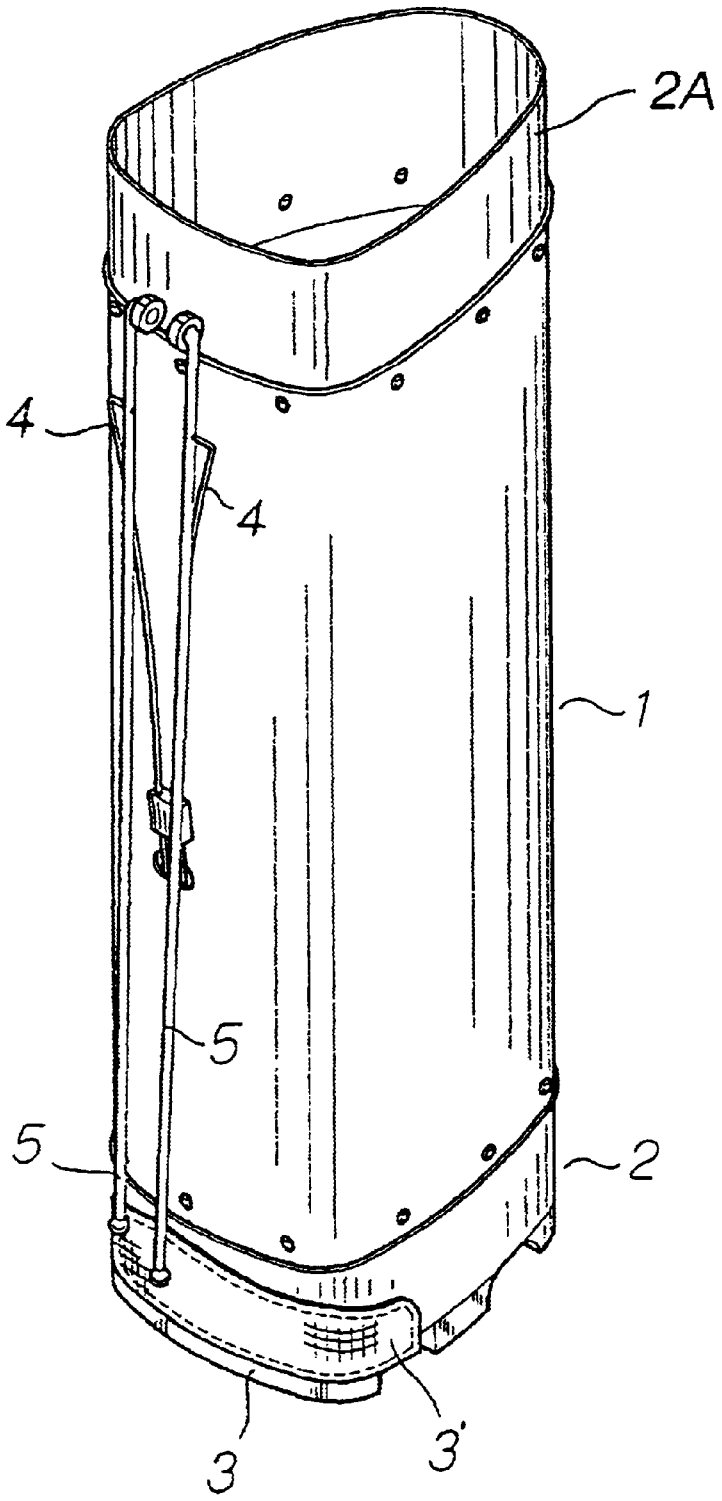
FIG. 2 is a perspective view of a first preferred embodiment of support mechanism mounted on golf bag according to the invention.

Referring to FIGS. 2 to 3, there is shown a golf bag support mechanism mounted on golf bag 1 constructed in accordance with the invention comprising a bottom member 2 including a space 21, an arcuate flange 22 projected on the edge of the opening of space 21, and a plurality of equally spaced holes 23 on the bottom side; a base 3 including a rectangular extension 31 having a plurality of equally spaced holes 311 and a perforation 32 between the extension 31 and the body of base 3; and a fabric (or resilient member of flexible cover) 3' coupled between bottom member 2 and base 3. In assembly, use rivets 3A to pass through holes 311 and 23 for securing base 3 to bottom member 2. This also encloses the space 21 (FIG. 3C).

The support mechanism further comprises two supports 4 having bottom ends pivotably coupled to base 3 and two legs 5 having top ends pivotably coupled to supports 4 (see FIGS. 2 and FIG. 3E).

In operation, user first pushes bag 1 toward legs 5. At this time, fabric 3' is compressed by the weight of bag 1 and golf clubs 9 contained therein. As such, supports 4 are bent to cause legs 5 to extend outward to form an inclined angle with respect to bag 1 (FIG. 3D). This forms a three-legged support (i.e., legs 5, bottom member 2, and base 3) for the golf bag 1 (FIG. 3E). As a result, golf bag 1 is stably inclined against the ground. Further, heads of golf clubs 9 are extended above the opening of bag 1 due to the compression of fabric 3' and slightly folded base 3 along the perforation 32. This facilitates the access of golf clubs 9. Moreover, this golf bag 1 is aesthetic due to no protruding components.

In the embodiments shown in FIGS. 3A–3E and FIGS. 4A–4C, the bottom member 2 is a container having a partially open bottom wall 20. The legs 5 are pivotally attached to the upper member 2A of the golf bag.

Referring to FIGS. 4A to 4C, there is shown a second preferred embodiment of support mechanism according to the invention. The differences between the first and second embodiments are detailed below. The holes 23, 311 of the first embodiment are replaced by a short tube member 24 of bottom member 2 and two short tube members 61, bolt 6A, and nut 6B of base 6 respectively. Also, perforation 32 is eliminated. Bolt 6A is passed through tube members 61 and 24 to fasten to nut 6B for forming a hinge, thus pivotably securing base 6 to bottom member 2. The operation of the second embodiment is the same as that of the first embodiment. Thus, a detailed description thereof is omitted herein for the sake of brevity.

Referring to FIGS. 5A and 5B, there is shown a third preferred embodiment of support mechanism according to the invention. The characteristics of the third embodiment is detailed below. The bottom surface of bottom member 7 is formed as a slant portion 71. Correspondingly, the cut out portion of bottom member 7 is filled with fabric (or resilient member) 3' coupled between bottom member 7 and base 8. The operation of the third embodiment is the same as that of the first embodiment. Thus, a detailed description thereof is omitted herein for the sake of brevity.

As shown in FIGS. 5-A and 5-B, the slant portion 71 (or a slant wall) encloses the bottom member 7, preventing items from falling therethrough, and base 6 is pivotally attached to the bottom member 2, below the slant wall 71 and connected to the support 4, such that the support 4 can pull the base 6 upwards towards the slant wall 71 (as shown in FIG. 5-B).

While the invention has been described by means of specific embodiments, numerous modifications and variations could be made thereto by those skilled in the art without departing from the scope and spirit of the invention set forth in the claims.

What is claimed is:

1. A support mechanism adapted for a golf bag having an upper member and a bottom member, comprising:

at least one leg pivotally connected to the upper member of the golf bag;

the bottom member of the golf bag comprises a bottom wall, an arcuate flange extending from the bottom wall to form an open space therebetween;

a pivoting base hinged to the bottom wall such that the pivoting base can pivot between the bottom wall and an lower side of the arcuate flange;

a fabric attached to the pivoting base and the bottom member to enclose the open space of the bottom wall, such that when the pivoting base is pivoted towards the lower side of the arcuate flange the fabric is collapsed;

an upper surface of the pivoting base is adapted to receive golf clubs thereon; and at least one support connects to the pivoting base and the at least one leg.

2. The support mechanism as claimed in claim 1, further comprising at least two legs and at least two supports.

* * * * *